United States Patent [19]

Giffard

[11] 3,998,727

[45] Dec. 21, 1976

[54] ELECTROSTATIC SEPARATOR

[76] Inventor: Philip John Giffard, PS1956 Nerang Road, Southport, Queensland, Australia

[22] Filed: Aug. 2, 1974

[21] Appl. No.: 494,290

[52] U.S. Cl. ..... 209/127 R

[51] Int. Cl.[2] ..... B03C 7/10

[58] Field of Search ..... 209/127–131, 209/231; 55/381, 386

[56] References Cited

UNITED STATES PATENTS

| | | | |
|---|---|---|---|
| 827,115 | 7/1906 | Pickard | 209/127 A |
| 1,551,397 | 8/1925 | Johnson | 209/129 |
| 2,027,309 | 1/1936 | Schacht | 209/127 R |
| 2,154,682 | 4/1939 | Johnson | 209/127 A X |
| 2,213,510 | 9/1940 | Wiegand | 209/127 A |
| 2,314,940 | 3/1943 | Hewitt | 209/127 R |
| 2,361,946 | 11/1944 | Johnson | 209/127 C |
| 2,466,371 | 4/1949 | Byrd | 209/128 |
| 2,839,189 | 6/1958 | Johnson | 209/127 R |
| 3,292,786 | 12/1966 | Kurzekwa | 209/129 |
| 3,370,703 | 2/1968 | Carpenter | 209/231 X |

*Primary Examiner*—Robert Halper
*Attorney, Agent, or Firm*—Arnold, White & Durkee

[57] ABSTRACT

An electrostatic separator unit comprises an arcuate feed plate, an arcuate screen co-axial with the feed plate, feed introduction means adapted to feed a mixture to be separated onto the feed plate for gravitational flow to the screen and an electrode above the screen. At least one of the feed plate, screen and feed introduction means is positionally adjustable rotationally about the common axis of feed plate and screen.

5 Claims, 5 Drawing Figures

2
14
15
14
21
25
20
9
(a)
26
39
36
11
11
12
(b)
12
26
39
11
(c)
6
12
(d)
11
(e)
6
9
2
52

ELECTROSTATIC SEPARATOR

This invention relates to electrostatic separators of the kind used to separate electrically conductive particles from a mixture of such particles with non-conductive particles. Typically, such separators are used for the separation of particulate metallic ores from crushed or ground gangue.

Customarily such separators comprise a planar inclined mesh screen onto and over which the feed mixture is flowed. The mixture is discharged onto the screen, usually from an inclined feed plate, so that initially it is travelling parallel to and in contact with the screen surface.

The screen extends below an electrostatically charged electrode spanning the full width of the screen. The screen is dimensioned so that all particles in the feed would pass through it in the absence of the electric field, and as the screen and feed plate are grounded, the conductive particles ("conductors") acquire a charge of opposite polarity to the electrode whereas the non-conductive particles ("non-conductors") remain un-charged. Thus the conductors are attracted towards the electrode and tend not to fall through the screen as readily as the non-conductors.

Thus the conductors tend to travel further before falling through the screen and when the separator is adjusted correctly, splitter type catchment means below and/or beyond the screen divide the feed into a conductors rich fraction and a non-conductors poor fraction.

In the more usual prior art separators the split is between particles discharged over the downstream end of the screen and all particles falling through it.

The behaviour of individual particles in the separator is largely determined by their individual masses and shapes and also the path followed by the particular particle in the stream flow across the feed plate.

In the treatment of mixtures of particles with varying ranges of characteristics, it is necessary to adjust the relative dispositions of the feed plate, screen and electrode to achieve effective separation. It is usually necessary to adjust not only the air gap between screen and electrode but also the effective length of the screen, the slope of the effective length of the screen and entry velocity of the feed particles to the screen.

In one type of known electrostatic separator of this kind, the screen is substantially planar, and is slidable with respect to the feed plate, as well as being adjustable as to its angle of inclination, so that its effective length and slope can be varied. However, varying the slope of the screen in such separators necessarily alters the shape of the air gap simultaneously. Moreover, the planar screen joins the arcuate or planar feed plate at an oblique angle instead of a smooth curve, so that the flowing feed stream suffers re-direction, and this is not conducive to consistent contact between all particles in the feed with the feed plate and the screen.

An object of the present invention is to provide a separator wherein the effective length of the screen, the slope of the effective length of the screen and, in preferred embodiments the entry velocity of the feed particles onto the screen may be varied to suit various feeds, while insuring consistent contact by all particles in the feed with the feed plate and screen, and without simultaneously altering the shape of the air gap between the electrode on one hand and the feed plate and screen on the other hand.

The invention consists in an electrostatic separator unit comprising an arcuate feed plate, a arcuate screen co-axial with the feed plate, feed introduction means adapted to feed a mixture to be separated onto the feed plate for gravitational flow to the screen and an electrode above said screen; at least one of said feed-plate, screen and feed introduction means being positionally adjustable rotationally about the common axis of feed plate and screen.

By way of example, an embodiment of the invention is described hereinafter with reference to the drawings herewith.

Figure 1:
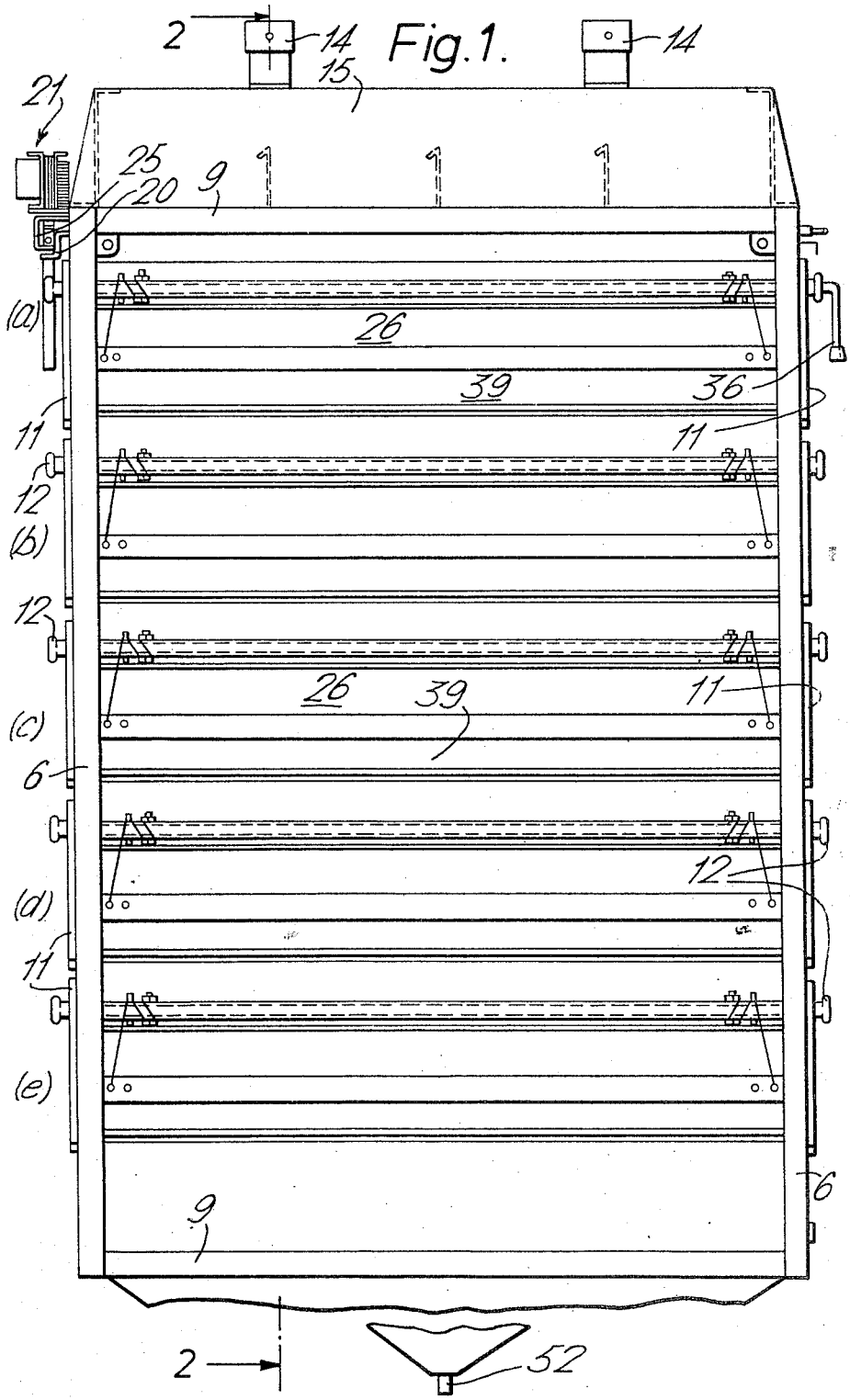
FIG. 1 is a side elevation of a multi-stage separator incorporating separating units according to the invention.
Figure 2:
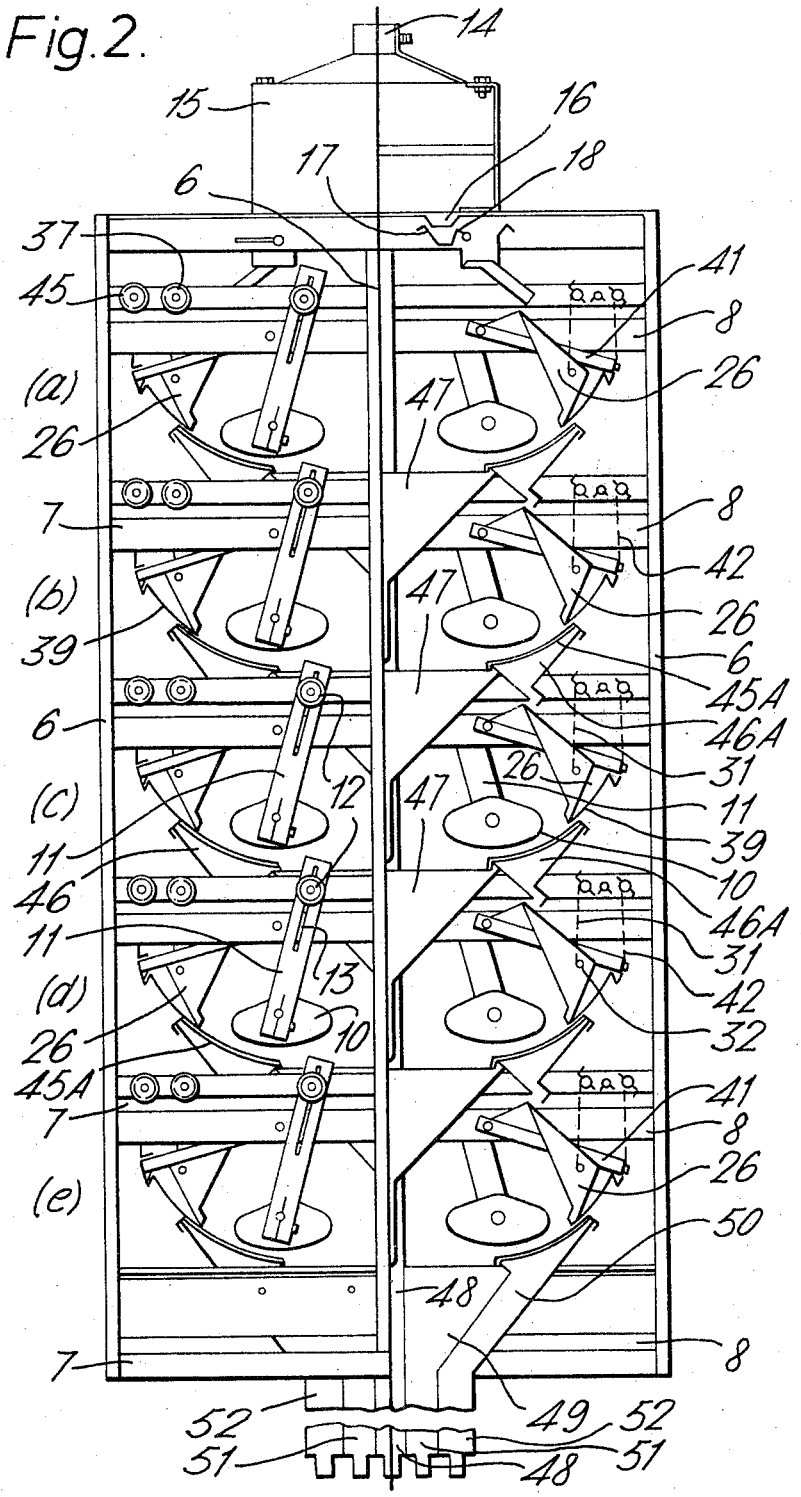
FIG. 2 is a front elevation of the separator of FIG. 1, but with a right hand front half cut-away to reveal a section taken as on line 2—2 of FIG. 1.
Figure 3:
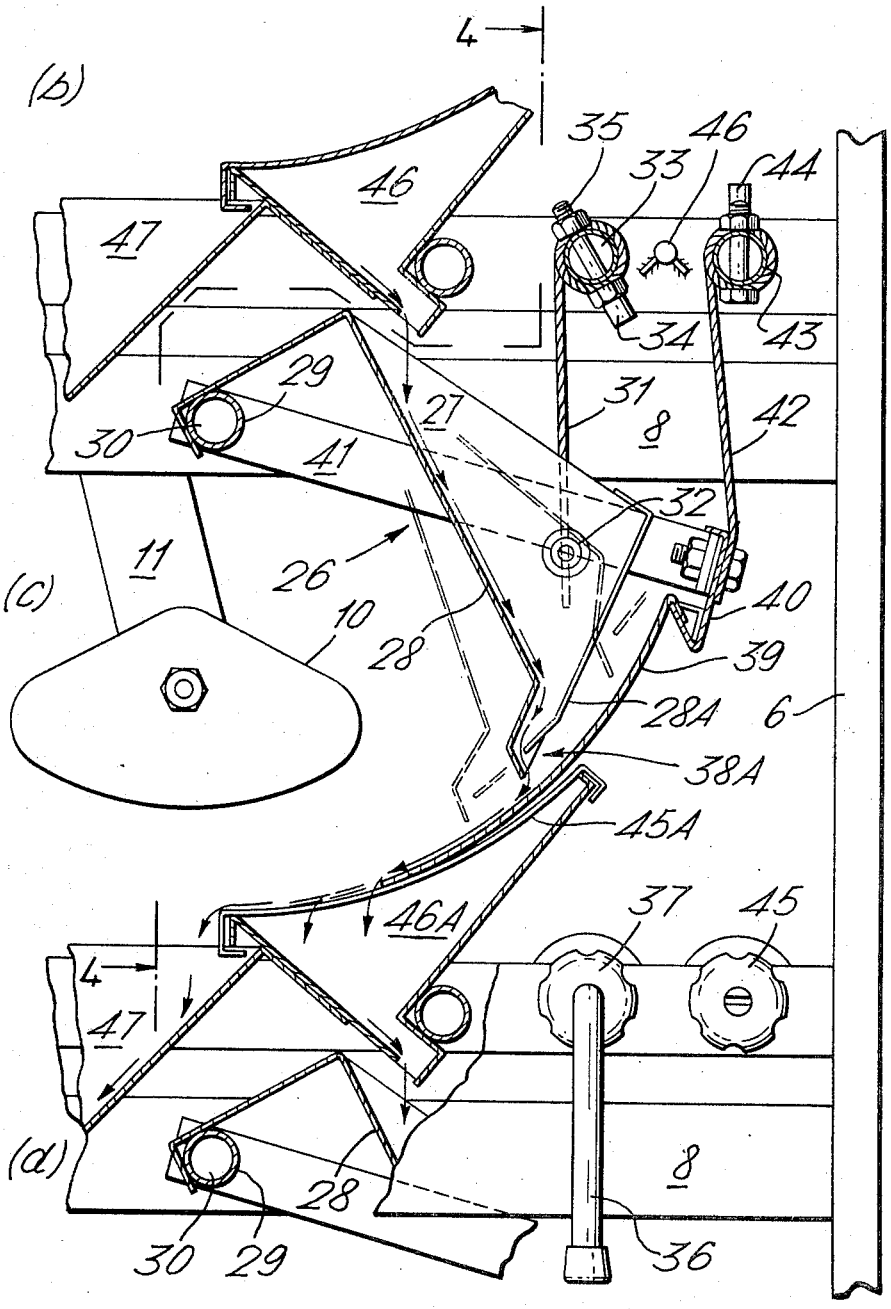
FIG. 3 is a cross-sectional view of one stage of the separator of FIG. 1 drawn to a larger scale.
Figure 4:
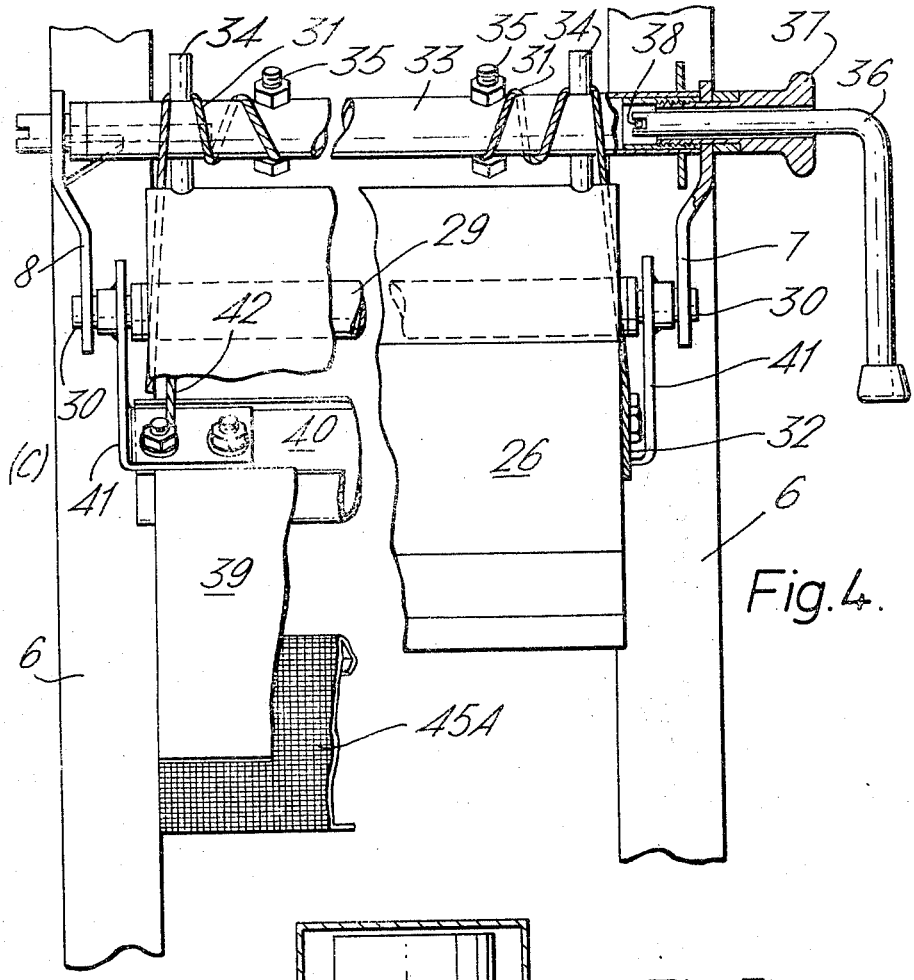
FIG. 4 is a view taken on line 4—4 of FIG. 3.

The illustrated separator is a five stage, twin stream separator, the stages are indicated as (*a*), (*b*), (*c*), (*d*) and (*e*) from the top down. Stages (*b*), (*c*) and (*d*) are identical in all respects while stage (*a*) differs only in that it includes initial feed input and control gate devices and stage (*e*) only in that its splitter-catchment means are adapted to discharge the separated feed fractions from the separator. Furthermore, the apparatus in respect of each feed stream is the same and thus the detailed illustration of one half of stage (*c*), for example as in FIGS. 3 and 4, will suffice to give a full comprehension of the invention, as its characteristic features are merely repeated in the other stages for each stream.

The apparatus of each stage, being essentially two units each according to the invention, is mounted in a skeletal box-like frame comprising upright members 6, and horizontal front, rear and side members 7, 8 and 9 respectively.

Each unit for each stream, includes a horizontal, tubular electrode 10 supported at each end by insulating arms 11. Each arm 11 is slotted at its upper end (as indicated by 13) and is clamped to a front member 7 or rear member 8 by a manually turnable clamping nut 12 on a threaded stud extending through the corresponding slot 13.

Thus each electrode 10 may be positionally adjusted as may be required. The electrode 10 is maintained at a positive or negative potential with respect to the frame and remainder of the separator by conventional devices (not shown) such as a supply voltage/high voltage transformer and high voltage rectifier.

The feed mixture is initially loaded through inlets 14 into a feed hopper 15 extending from front to back of the separator.

The hopper 15 has two rows of outlet spouts 16 feeding into two header troughs 17, one side of each of which is in the form of a swing mounted gate 18.

Figure 5:
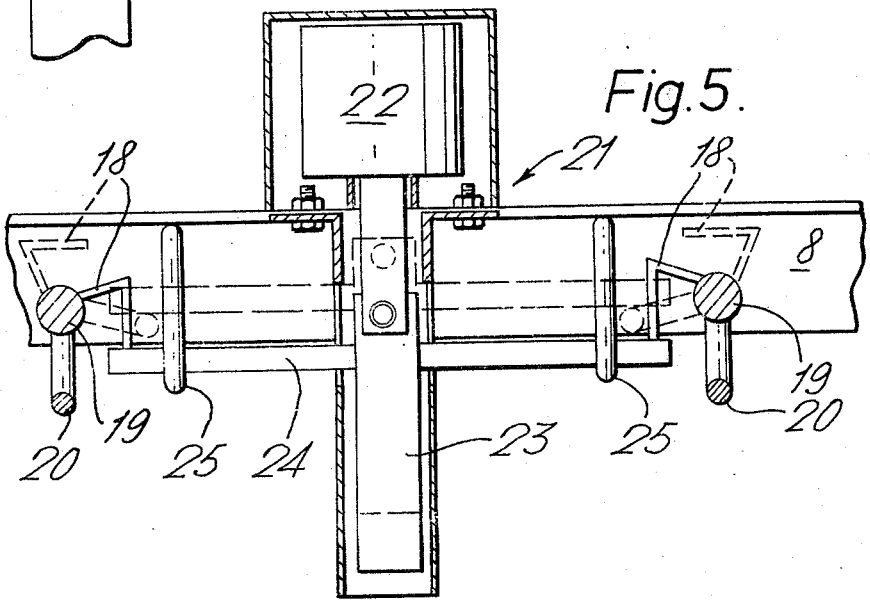
FIG. 5 is a sectional view of solenoid feed gate means, being a component of the separator of FIG. 1.

Each gate 18 (see FIG. 5) is pivotally supported by pins 19 at each end and is furnished with a right-angled striker arm 20 at one end. Adjacent this one end is a solenoid gate operating mechanism 21.

The operating mechanism 21 comprises a solenoid 22 able, when energised, to lift a counter-weight 23 and a cross-bar 24. When the solenoid is de-energised the weight 23 is supported by cross-bar 24 resting in stirrups 25. The gates 18 then are in their closed positions as shown in full line in FIG. 5. When the solenoid 22 is energised it lifts the cross-bar 24 and allows the gate 18 to be rotated manually into a stable open position as shown in broken line in FIG. 5. This also brings an end of each striker arm 20 into a position below the elevated cross-bar 24 so that on de-energisation of the solenoid 22 the weight 23 is effective to slam the gates closed. It will be noted that this is a "fail-safe" arrangement in that the gates are closed to shut off feed in the event of a power supply failure.

The header trough 17 feeds into a swing mounted feed chute 26 which, together with the above described hopper and gate arrangements, constitutes the feed introduction means of stage (*a*). The operation of stage (*a*) and the flow of feed through it will be understood from the following description of stage (*c*).

Stage (*c*) includes a swing mounted distributor chute 26 the same as in every other stage.

Chute 26 comprises two substantially triangular end plates 27, a floor plate 28 and a back plate 28A extending from one end plate 27 to the other. The floor plate 28 extends to and is welded to a tubular shaft 29 furnished with journal ends 30 rotatable in journal holes formed in the members 7 and 8.

The chute 26 is suspended by two flexible chute support cables 31 extending from threaded posts and clamps nuts 32 to and around a chute capstan shaft 33.

Each cable 31 extends around a stop peg 34 piercing the shaft 33 to clamp bolt 35 also piercing the shaft 33. Thus rotation of the capstan shaft 33 causes the chute 26 to swing upwardly or downwardly as the case may be.

Such rotation may be effected by means of a removable crank handle 36 adapted to extend through a tubular locking knob 37. Handle 36 is slotted at one end to engage a cross-pin 38 extending across the bore of the tubular shaft 33.

The knob 37 may be slacked off to free the shaft 33 which may then be rotated to adjust the inclination of the chute 26 whereupon the knob may be tightened to clamp the shaft in selected adjustment.

The adjacent edge margins of the plates 28 and 28A are shaped to form an outlet slot 38A for the feed and deposit same on a part cylindrical feed plate 39.

The feed plate 39 hangs as an apron from a longitudinally flanged strap 40 bolted at each end to radial arms 41 journaled upon the respective journal ends 30.

The strap 40 is suspended from two feed plate support cables 42 extending to and about a feed plate capstan shaft 43.

The capstan shaft 43 is similar to shaft 33 and is likewise furnished with stop pegs 44 and clamp knobs 45 similar to the corresponding components associated with shaft 33.

Thus the feed plate 39 may be positionally adjusted by manual rotation and subsequent clamping of the shaft 43 in exactly the same way as with the chute 26.

Moreover, as both chute 26 and plate 39 swing about the same axis, and an that axis is the axis of curvature of the plate, the spaced relationship between the outlet slot 38A and the plate 39 remains constant for all positions of both components.

The range of movement of chute 26 and feed plate 39 is limited by buffer means 46 positioned to obstruct the stop pins 34 and 44.

The feed plate 39 overlies an arcuate screen 45A.

The screen 45A is supported by splitter-catchment means comprising a non-conductors chute 46A and a conductors chute 47 secured together. The non-conductors chute 46A catches all particles falling through the screen 45A and feeds them elsewhere as may be required or into the distributor chute 26 of the next lower stage (in the present instance stage (*d*)). The conductors chute 47 catches all particles passing over the down-stream edge of the screen 45A, and feeds them into a conductors output duct 48.

The bottom stage (*e*) differs from stage (*c*) in that its splitter-catchment means comprise two chutes 49 and 50 which feed directly into a semi-conductor outlet duct 51 and a non-conductor outlet duct 52 respectively.

In use, the mixture of particles to be separated gravitates on to the floor plate 28 of chute 26, and thence on to the feed plate 39. Chute 26 may be adjusted about the centre of rotation, namely the rotational axis of shaft 29, by operation of shaft 33 so that the locus of the discharge end of chute 26 remains concentric with the feed plate 39 the adjustment movability and the curvature of which are also centred in the same axis of rotation.

Thus, the velocity at which the particles travel onto the screen 45A may be controlled by varying the position of the feed chute 26. If chute 26 is raised the effective path length of the feed plate is increased by bringing its steeper upper portions into effective use, hence allowing increased acceleration of the particles in their movement towards the screen. During passage down and across the feed plate and the screen, the particles traverse a substantially continuous concave surface and are therefore centrifugally influenced to remain in intimate and consistent contact with that surface except insofar as the conductors are influenced to skim across the screen by reason of the field due to electrode 10.

In the illustrated embodiment of the invention both the feed chute and feed plate are adjustable.

In other embodiments the screen is supported by radial arms in a manner similar to that of the feed plate and is also adjustable.

In still other embodiments the screen and chute are adjustable and the feed plate fixed, while in yet other embodiments only one relevant component, preferably the feed plate, is adjustable.

Preferably the position of the electrode 10 is also adjustable, in conventional manner, to give optimum operational condition for any combination of positions of screen 45A feed plate 39 and feed chute 26. It is to be noted that adjustments of the screen, feed plate and feed chutes have no significant effect on the overall shape of the field air gap.

The claims defining the invention are as follows:

1. An electrostatic separator unit comprising:

an arcuate feed plate;

a feed introduction means adapted for feeding a mixture to be separated onto said feed plate, said feed introduction means being pivotally mounted and rotationally adjustable about a common axis with said feed plate;

an arcuate screen adapted for receiving gravitational flow of the mixture from said feed plate;

an electrode positioned above said screen, said electrode adapted for maintaining an electrostatic charge opposite to said feed plate and screen, said screen dimensioned such that said mixture would pass through said screen absent a potential difference between said screen and said electrode;

means for rotationally positioning at least one of said feed plate and feed introduction means about a common axis of said plate and feed introduction means wherein the arcs comprising the arcuate shapes of the feed plate and screen are coaxial with said common axis.

2. The unit according to claim 1 wherein said feed introduction means include a feed chute which is rotationally adjustable so that the locus of the discharge outlet of said chute is a circular arc concentric with said feed plate.

3. The unit according to claim 2 wherein said at least one of feed plate and feed chute is independently suspended by cables attached to a capstan means independently operable to adjust the positions thereof.

4. The unit according to claim 1 including means for adjustably positioning said electrode relative to said screen.

5. An electrostatic separator comprising:

a plurality of units, each unit comprising:

an arcuate feed plate;

a feed introduction means adapted for feeding a mixture of conductors and nonconductors to be separated onto said feed plate, said feed introduction means being pivotally mounted and rotationally adjustable about a common axis with said feed plate;

an arcuate screen adapted for receiving gravitational flow of the mixture from said feed plate;

an electrode positioned above said screen, said electrode adapted for maintaining an electrostatic charge opposite to said feed plate and screen, said screen dimensioned such that said mixture would pass through said screen absent a potential difference between said screen and electrode;

means for rotationally positioning at least one of said feed plate and feed introduction means about a common axis of said feed plate and feed introduction means wherein the arcs comprising the arcuate shapes of the feed plate and screen are coaxial with said common axis;

said plurality of units being arranged in cascading sequential series so that each preceeding unit discharges its screened nonconductors as feed to the next succeeding unit;

means for collecting the separated conductors from each unit; and means for collecting the separated conductors and nonconductors from the last unit of said cascading sequential series.

* * * * *